US008459216B2

(12) United States Patent
Klejeski et al.

(10) Patent No.: US 8,459,216 B2
(45) Date of Patent: Jun. 11, 2013

(54) AIR DISTRIBUTION SCROLL WITH VOLUTE ASSEMBLY

(75) Inventors: Anthony T. Klejeski, Bethel, MN (US); Benjamin J. Kirchoff, Woodbury, MN (US)

(73) Assignee: Cummins Power Generation IP, Inc., Minneapolis, MN (US)

( * ) Notice: Subject to any disclaimer, the term of this patent is extended or adjusted under 35 U.S.C. 154(b) by 379 days.

(21) Appl. No.: 12/798,495

(22) Filed: Apr. 5, 2010

(65) Prior Publication Data

US 2010/0263609 A1 Oct. 21, 2010

Related U.S. Application Data

(60) Provisional application No. 61/166,282, filed on Apr. 3, 2009.

(51) Int. Cl.
*F02F 1/34* (2006.01)

(52) U.S. Cl.
USPC ..... 123/41.6; 123/41.12

(58) Field of Classification Search
USPC ..... 123/41.6, 41.12; 310/50, 52, 58; 290/1 A, 290/1 B
See application file for complete search history.

(56) References Cited

U.S. PATENT DOCUMENTS

| | | | | |
|---|---|---|---|---|
| 2,209,363 | A * | 7/1940 | Sutherland | 290/1 B |
| 3,714,449 | A | 1/1973 | De Bella | |
| 4,104,993 | A | 8/1978 | Baguelin | |
| 4,231,717 | A * | 11/1980 | Onishi | 417/364 |
| 4,677,940 | A | 7/1987 | Bracht et al. | |
| 4,835,405 | A * | 5/1989 | Clancey et al. | 290/1 A |
| 5,433,175 | A * | 7/1995 | Hughes et al. | 123/2 |
| 5,626,105 | A | 5/1997 | Locke et al. | |
| 5,678,512 | A | 10/1997 | Colton | |
| 5,908,011 | A | 6/1999 | Stauffer et al. | |
| 6,028,369 | A * | 2/2000 | Hirose et al. | 290/1 A |
| 6,230,667 | B1 | 5/2001 | Stauffer et al. | |
| 6,489,690 | B1 * | 12/2002 | Hatsugai et al. | 290/1 A |
| 6,630,756 | B2 | 10/2003 | Kern et al. | |
| 7,023,101 | B2 * | 4/2006 | Wang | 290/1 A |
| 7,129,604 | B1 * | 10/2006 | Wang | 310/63 |
| 2007/0227470 | A1 * | 10/2007 | Cole et al. | 123/3 |
| 2009/0194041 | A1 | 8/2009 | Lobsiger | |

FOREIGN PATENT DOCUMENTS

| | | | |
|---|---|---|---|
| DE | 10117245 | A1 * | 10/2002 |
| EP | 0376352 | B1 | 10/1994 |
| JP | 58197416 | A | 11/1983 |

* cited by examiner

*Primary Examiner* — Noah Kamen
*Assistant Examiner* — Long T Tran
(74) *Attorney, Agent, or Firm* — Krieg DeVault LLP

(57) ABSTRACT

An apparatus is disclosed including a fan producing an outlet fluid flow, and an inlet receiving an inlet stream and operably coupled to the fan. The apparatus further includes a divider separating the outlet flow into a first outlet stream and a second outlet stream, a first flow path directing the first outlet stream to a first heat transfer device thermally coupled to a first heat generating device, and a second flow path directing the second outlet stream to a second heat transfer device thermally coupled to a second heat generating device. In certain embodiments, the first and second heat transfer devices are a radiator and a surface of a generator, and the first and second heat generation devices are an internal combustion engine and the generator.

16 Claims, 3 Drawing Sheets

AIR DISTRIBUTION SCROLL WITH VOLUTE ASSEMBLY

RELATED APPLICATIONS

The present application claims the benefit of U.S. Provisional Patent Application No. 61/166,282 filed on Apr. 3, 2009, which is hereby incorporated by reference in its entirety.

BACKGROUND

The present application relates generally to power plant cooling devices, and more particularly relates to cooling an engine and a coupled generator. Engine and generator sets are often installed in mobile applications. In such applications, installation space is often at a premium, and flexibility in physical configuration of components is often desirable. Certain available systems flow air serially through the radiator first and then across the generator second, across the generator first and then through the radiator second, or require multiple fans or blowers to move cooling air—these and other available cooling systems can suffer from various drawbacks. Accordingly, there is a demand for further contributions in this area of technology.

SUMMARY

One embodiment is a unique technique for cooling multiple heat generating devices. A further embodiment is directed to an apparatus or method that divides an inlet cooling stream into multiple outlet cooling streams where each outlet stream is directed at a heat radiating device of a genset. Other embodiments include unique methods, systems, and apparatus to provide multiple heat generating devices with cooling streams. Further embodiments, forms, objects, features, advantages, aspects, and benefits shall become apparent from the following description and drawings.

DESCRIPTION OF THE ILLUSTRATIVE EMBODIMENTS

Figure 1:
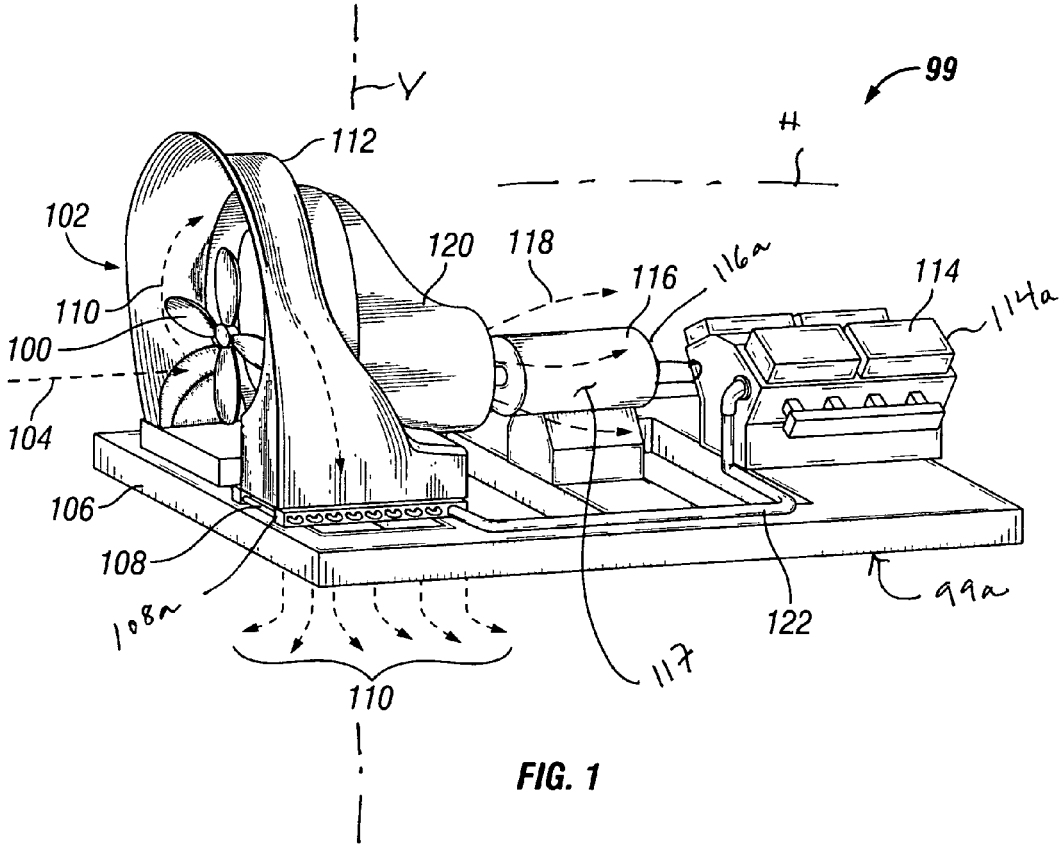
FIG. 1 is a partial schematic, perspective view of a genset cooling system.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and that any further applications of the principles of the invention as illustrated therein as would normally occur to one skilled in the art to which the invention relates are contemplated and protected.

FIG. 1 is a schematic illustration of a genset cooling system 99. The system 99 includes genset 99*a* that is cooled by fluid flow produced with a fan 100. The fan 100 imparts an axial flow velocity component and a radial flow velocity component to the outlet fluid flow. The axial flow velocity component is imparted to a first portion of the outlet flow, and the radial flow velocity component is imparted to a second portion of the outlet flow. The system 99 further includes an inlet 102 operably coupled to the fan, where the inlet 102 receives and inlet stream 104.

The system 99 further includes a divider 112 that divides the outlet fluid flow into a first outlet stream 110 and a second outlet stream 118. The divider 112 includes a volute with an expanding geometry, where the volute at least partially defines an outer circumference of the fan 100, and where the volute circumferentially removes a portion of the outlet fluid flow to form the first outlet stream 110. The volute may be sized and positioned to withdraw as the first outlet stream 110 the desired amount of the inlet stream 104. The divider 112 may be any device that separates the outlet flow, for example a housing 120 or other exit nozzle device structured to receive an axial portion 118 of the fan outlet and a second device such as a volute to receive a circumferential portion 110 of the fan outlet.

In the depicted embodiment, a first flow path, for example defined by the volute outlet in FIG. 1, directs the first outlet stream 110 to a first heat transfer device 108. The first heat transfer device 108 is thermally coupled to a first heat generation device 114. In one example, the first heat transfer device 108 is a radiator 108*a* thermally coupled to an internal combustion engine 114*a* by a coolant circulating line 122. The coolant circulating line 122 is shown only schematically, and does not include a return line, a thermostat, or other features that may be present in certain embodiments. The radiator 108*a* can be mounted horizontally as illustrated.

The system 99 includes a second flow path, for example defined by a housing 120, that directs the second outlet stream 118 to a second heat transfer device 116. The second heat transfer device 116 is thermally coupled to a second heat generation device. In the illustration of FIG. 1, the second heat generation device is an electric power generator 116*a*, and the second heat transfer device 116 is a surface 117 of the electric generator 116*a*. The surface 117 of the electric generator 116*a* may include fins (not shown) or other features to enhance heat transfer. The engine 114*a* is an internal combustion engine, for example a natural gas powered engine, and the generator provides auxiliary power for the system 99. However, any heat generating devices provided for any purpose, and any heat transfer devices, may be included in particular embodiments of a system 99. The axial stream 118 may pass to either the first or second heat transfer device 108, 116, and the circumferential stream 110 passes to the other device 108, 116. Correspondingly, both heat transfer devices 108, 116 receive air flow that has not already been heated by the cooling of a heat generating device.

It should be appreciated that genset 99*a* includes both the engine 114*a* and the electric power generator 116*a*. Generator 116*a* is mechanically coupled to engine 114*a* to be driven by engine 114*a*. The generator/engine coupling may include intermediate gearing, belt drives, torque converters, clutches, and/or other mechanical linkage, or may be a "direct drive" type in which a rotor of generator 116*a* is integral with and/or fixed to a rotary power shaft of engine 114*a*. System 99 further includes a stationary skid bed 106, and the fan 100, air inlet 102, divider 112, first flow path, second flow path, radiator 108*a*, generator 116*a*, and engine 114*a* are mounted on the skid bed 106. The skid bed 106 may be a portion of a mobile application, for example loadable on a flatbed truck, rail car, or other vehicle. As depicted in FIG. 1, generator 116*a* is positioned between fan 100 and engine 114*a* along a longitudinal axis approximately parallel to the horizontal axis H. Vertical axis V is also depicted in FIG. 1.

In a further embodiment, the first outlet stream 110 does not contact any other heat transfer devices before contacting the first heat transfer device 108 and the second outlet stream 118 does not contact any other heat transfer device before contacting the second heat transfer device 116. In the illustration of FIG. 1, the heat transfer devices 108, 116 receive air or other heat transfer gases at a temperature substantially similar to an ambient temperature, although in other embodiments the air or other heat transfer gases may be at a temperature varying from ambient. Incidental heat introduced into the outlet streams 110, 118 due to fan 100 compression, from heat transfer from volute 112 walls, and from heat transfer from housing 120 walls is generally not heat transfer from a heat transfer device for the purposes herein. However, if heat is purposefully supplied to a portion of one of the flow paths, for example by intentionally exchanging external heat to the housing 120, then that portion of the flow path may be considered a heat transfer device if the amount of external heat supplied is substantial.

Figure 2A:
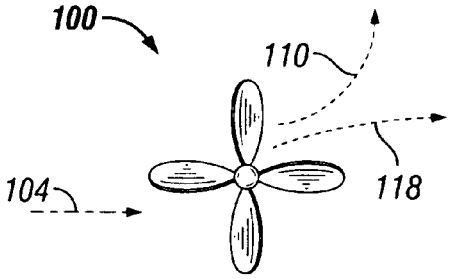
FIGS. 2A and 2B are each a partial schematic illustration of a fan that may be used with the system of FIG. 1.
Figure 2B:
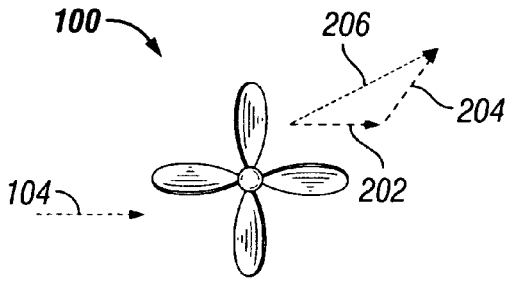

FIG. 2 is a schematic illustration of a fan 100. Referencing FIG. 2A, the fan 100 receives the inlet flow 104 and provides a first outlet stream 110 and a second outlet stream 118. The fan 100 is structured to receive the inlet flow 104 and to impart an axial flow component 202 and a radial flow component 204 to a total outlet flow component 206 leaving the fan 100. The fan 100 may provide the axial flow component 202 and a radial flow component 204 by providing the outlet flow having the total flow component 206 impinging on the divider 112 such that a portion of the outlet flow exits the volute as the first outlet flow 110 and another portion of the outlet flow exits the volute as the second outlet flow 118. In certain embodiments, the fan 100 may provide the axial flow component 202 and a radial flow component 204 by pressurizing the outlet flow toward a housing 120, where some of the pressurized outlet exits as the second outlet stream 118 and some of the pressurized outlet exits circumferentially out the divider 112 as the first outlet stream 110. In various embodiments, the fan 100 provides an outlet stream flow component 206 dominated by the axial flow component 202 (e.g. an axial compressor with a stator) and/or provides an outlet stream flow component 206 dominated by the radial component 204 (e.g. a centrifugal compressor). The shaping of the divider 112, the housing 120, and the pitch of the fan 100 allow one of skill in the art to provide a selectable portion of flow as the first outlet stream 110 or the second outlet stream 118. It should be appreciated that stream 110 discharges along axis V lateral to axis H. Further, while this discharge is downward along axis V in the depicted arrangement, it may be upward and/or to the side with this lateral discharge arrangement in other embodiments.

Figure 3:
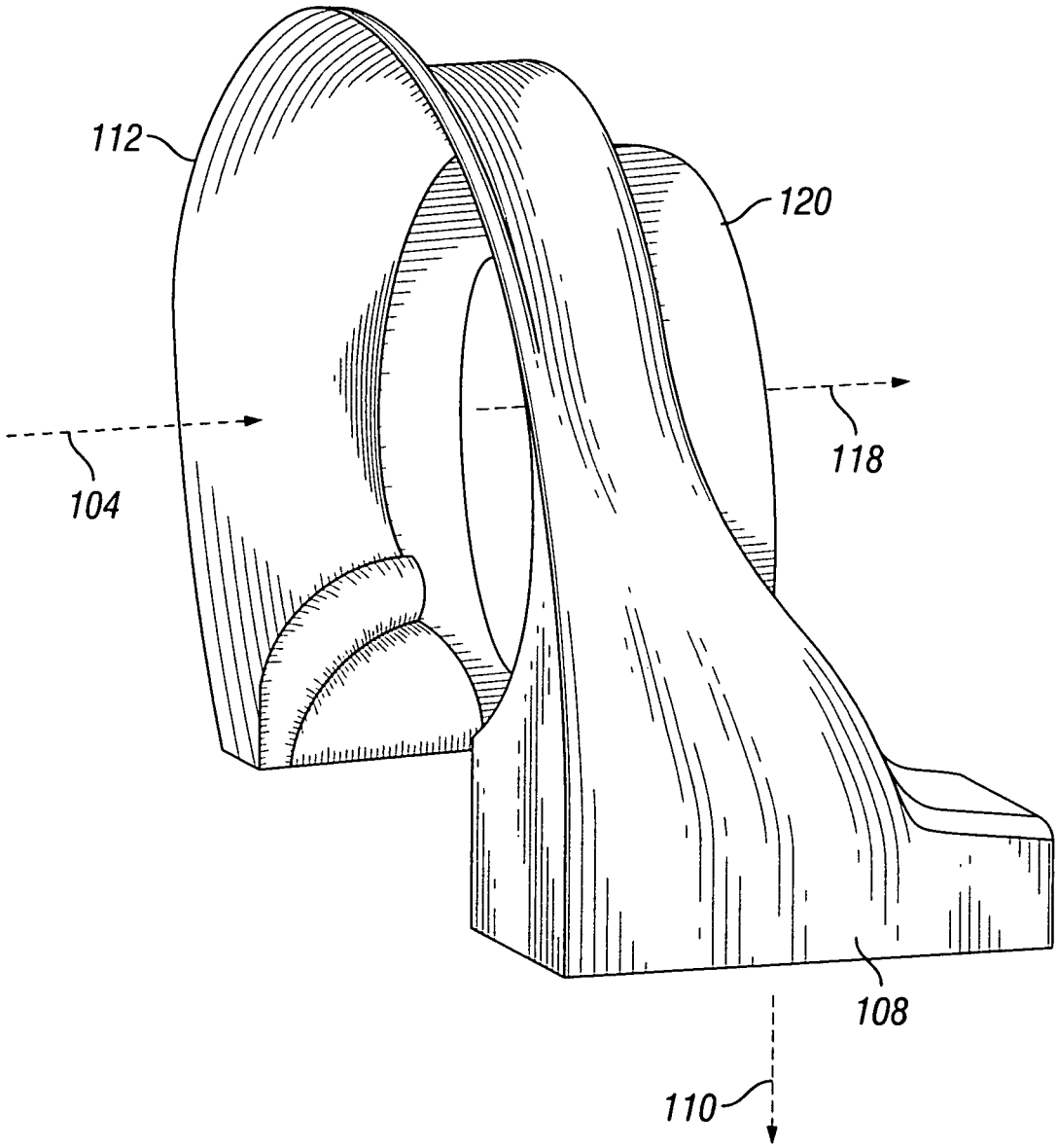
FIG. 3 is a partial schematic, perspective view of a volute that may be used in the system of FIG. 1.

FIG. 3 is a schematic illustration of a divider 112 comprising a volute. The volute may be formed from the same material as the housing 120 or from a different material, and may be affixed to the housing 120 or formed integrally with the housing 120. The divider 112 at least partially defines an outer circumference of the fan 100, and may fully define the outer circumference of the fan 100. The divider 112 is designed so that when used in combination with a centrifugal or semi-centrifugal fan 100 a first outlet stream 110 is provided separated from the inlet stream 104 and from the second outlet stream 118. The divider 112 may be designed to impinge on the flow stream of an axial fan 100 to provide the first outlet stream 110 separated from the inlet stream 104 and from the second outlet stream 118. The divider 112 in the embodiment of FIG. 3 has an expanding geometry to remove a desired portion of the outlet fluid flow from fan 100 at a desired flow velocity, for example a desired flow velocity through a radiator 108. The geometry of the divider 112 is modified to provide the desired flow velocity, including speed and exit direction. The exit speed is selectable by sizing the divider 112 outlet in relation to the first outlet stream 110 flow rate, and the exit direction is selectable by directing the divider 112 outlet in the desired exit direction.

Figure 4:
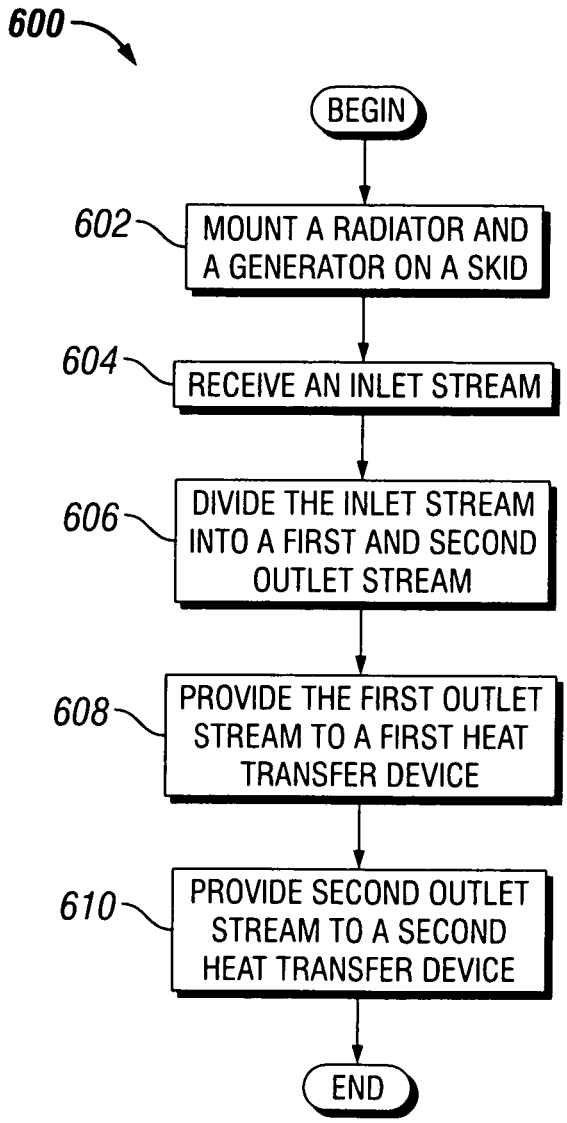
FIG. 4 is a flowchart of a technique for cooling that may be performed with the system of FIG. 1.

The schematic flow diagram in FIG. 4 and related description which follows provides an illustrative embodiment of performing a technique for cooling two heat generating devices with a single inlet stream. Operations illustrated are understood to be exemplary only, and operations may be combined or divided, and added or removed, as well as reordered in whole or part, unless stated explicitly to the contrary herein.

FIG. 4 is a schematic flow diagram of an exemplary technique 600 for cooling two heat generating devices with a single inlet stream. The technique 600 includes an operation 602 to mount a radiator and a generator on a skid. The technique 600 further includes an operation 604 to receive an inlet stream, and dividing 606 the inlet stream into a first and second outlet stream. The technique 600 further includes an operation 608 to provide the first outlet stream to a first heat transfer device, and an operation 610 to provide the second outlet stream to a second heat transfer device.

As is evident from the figures and text presented above, a variety of embodiments according to the present invention are contemplated.

One exemplary embodiment is a system including a fan structured to produce an outlet fluid flow, and an inlet operably coupled to the fan where the inlet receives an inlet stream. The exemplary embodiment further includes a divider that separates the outlet fluid flow into a first outlet stream and a second outlet stream, a first flow path that directs the first outlet stream to a first heat transfer device thermally coupled to a first heat generating device, and a second flow path that directs the second outlet stream to a second heat transfer device thermally coupled to a second heat generating device. In a further exemplary embodiment, the first and/or second heat transfer devices include a radiator and a surface of a generator. In one example the radiator is mounted horizontally. The first and/or second heat generating devices include the generator and an internal combustion engine. The fan in one embodiment is structured to impart an axial flow velocity component and a radial flow velocity component to the outlet fluid flow. The divider includes a volute with an expanding geometry, the volute at least partially defining an outer circumference of the fan, where the volute circumferentially removes a portion of the outlet fluid flow to form either the first outlet stream or the second outlet stream.

In another exemplary embodiment, a method includes receiving an inlet stream, and dividing the inlet stream into a first outlet stream and a second outlet stream. The method further includes providing the first outlet stream to a first heat transfer device thermally coupled to a first heat generating device, and providing the second outlet stream to a second heat transfer device thermally coupled to a second heat generating device. The first heat transfer device and the second heat transfer device include a radiator and a surface of a generator. The method includes providing the heat generating devices as a generator and an internal combustion engine. The exemplary method includes mounting the radiator, generator, internal combustion engine, fan, and/or volute on a skid. In a further embodiment, the method includes mounting the radiator horizontally on the skid.

Yet another exemplary embodiment is a system including: a fan structured to impart an axial flow velocity component and a radial flow velocity component to an outlet fluid flow; an inlet operably coupled to the fan, the inlet receiving an inlet stream; a divider including a volute with an expanding geometry, the divider structured to separate the outlet fluid flow into a first outlet stream and a second outlet stream, wherein the volute at least partially defines an outer circumference of the fan, and wherein the volute circumferentially removes a portion of the outlet fluid flow to form the first outlet stream; a first flow path directing the first outlet stream to a radiator, wherein the radiator is thermally coupled to an engine; and a second flow path directing a second outlet stream to a surface of a generator. In one example of the aforementioned embodiment, the radiator is mounted horizontally. In one example of the aforementioned embodiment, the system further includes a stationary skid with the fan, the air inlet, the divider, the first flow path, the second flow path, the radiator, the generator, and the engine all mounted on the stationary skid. In one example, the engine is an internal combustion engine. In one example, the generator includes an electric generator.

While the invention has been illustrated and described in detail in the drawings and foregoing description, the same is to be considered as illustrative and not restrictive in character, it being understood that only certain illustrative embodiments have been shown and described and that all changes and modifications that come within the spirit of the inventions are desired to be protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a genset including an internal combustion engine structured to drive an electric power generator, the engine being thermally coupled to a heat transfer device;

a fan structured to produce a cooling fluid outlet flow;

a divider structured to separate the cooling fluid outlet flow produced by the fan into a first cooling stream and a second cooling stream;

a first flow path to direct the first cooling stream to the heat transfer device; and a second flow path to direct the second cooling stream to the generator, wherein the divider includes a volute with an expanding geometry, the volute at least partially defining an outer circumference of the fan, wherein the volute circumferentially removes a portion of the cooling fluid outlet flow to form one of the first cooling stream and the second cooling stream, and the divider further includes a housing extending from the volute to receive the other of the first cooling stream and the second cooling stream.

2. The apparatus of claim 1, wherein the heat transfer device includes a radiator.

3. The apparatus of claim 1, wherein the first flow path is structured to direct the first cooling stream along a first axis and the second flow path is structured to direct the second cooling stream along a second axis, the first axis and the second axis intersecting each other, and the generator being positioned between the fan and the engine along the second axis.

4. The apparatus of claim 1, wherein the divider includes means for directing the first cooling stream in a lateral direction relative to the second cooling stream.

5. The apparatus of claim 1, wherein the fan is structured to impart an axial flow velocity component and a radial flow velocity component to the cooling fluid outlet flow.

6. The apparatus of claim 1, further comprising a bed, the genset being mounted to the bed to be carried therewith, the bed defining an aperture to discharge one of the first cooling stream and the second cooling stream.

7. An apparatus comprising:

a fan structured to produce a cooling fluid outlet flow;

a divider structured to separate the cooling fluid outlet flow into a first cooling stream and a second cooling stream;

a first flow path to direct the first cooling stream along a first axis to a first heat transfer device thermally coupled to a first heat generating device; and a second flow path to turn the second cooling stream away from the first axis to a second heat transfer device thermally coupled to a second heat generating device, and discharge the second cooling stream laterally in relation to the first axis, wherein the divider includes a volute at least partially defining an outer circumference of the fan, wherein the volute circumferentially removes a portion of the cooling fluid outlet flow to form one of the first cooling stream and the second cooling stream and the divider further includes a housing extending from the volute to receive the other of the first cooling stream and the second cooling stream.

8. The apparatus of claim 7, wherein at least one of the first and second heat transfer devices comprise a radiator, and wherein at least one of the first and second heat generating devices comprise a surface of a generator.

9. The apparatus of claim 7, wherein the fan is structured to impart an axial flow velocity component with respect to the first axis and a radial flow velocity component about the first axis to the cooling fluid outlet flow.

10. The apparatus of claim 7, wherein the second flow path includes means for discharging the second cooling stream along a second axis generally perpendicular to the first axis.

11. A method, comprising:

driving an electric power generator with an internal combustion engine, the engine being thermally coupled to a radiator;

generating a cooling fluid outlet flow;

dividing the cooling fluid outlet flow into a first stream and a second stream;

directing the first stream to the radiator; and directing the second stream to the generator, wherein the dividing the cooling fluid outlet flow includes circumferentially removing a portion of the cooling fluid outlet flow with a volute having an expanding geometry to form one of the first cooling stream and the second cooling stream, and dividing the cooling fluid outlet flow further includes receiving the other of the first cooling stream and the second cooling stream through a housing extending from the volute.

12. The method of claim 11, which includes:

performing the generating of the cooling fluid outlet flow with a fan, the generator being positioned between the fan and the engine; and further directing the second stream to the engine.

13. The method of claim 12, which includes carrying the fan, the generator, and the engine along an axis on a bed.

14. The method of claim 12, which includes discharging the first stream through the radiator in a direction lateral to the axis.

15. An apparatus, comprising:

an outlet cooling fluid stream;

a dividing means that divides the outlet cooling fluid stream into a first cooling stream and a second cooling stream;

a first heat generation device thermally coupled to a first heat transfer device;

a second heat generation device thermally coupled to a second heat transfer device; and a cooling means that directs the first cooling stream to the first heat transfer device and that directs the second cooling stream to the second heat transfer device, wherein the dividing means includes a volute with an expanding geometry that circumferentially removes a portion of the outlet cooling fluid stream flow to form one of the first cooling stream and the second cooling stream, and the dividing means further includes a housing extending from the volute to receive the other of the first cooling stream and the second cooling stream.

16. The apparatus of claim 15, wherein the first heat generation device comprises an engine, wherein the first heat transfer device comprises a radiator, wherein the second heat generation device comprises an electric generator, and wherein the second heat transfer device comprises a surface of the electric generator.

* * * * *